US007014309B2

(12) United States Patent
Aukerman

(10) Patent No.: US 7,014,309 B2
(45) Date of Patent: Mar. 21, 2006

(54) INK DRYING SYSTEM FOR HIGH SPEED PRINTING

(76) Inventor: Robert W. Aukerman, 228 NE. Azalea Dr., Corvallis, OR (US) 97330

( * ) Notice: Subject to any disclaimer, the term of this patent is extended or adjusted under 35 U.S.C. 154(b) by 0 days.

(21) Appl. No.: 10/066,066

(22) Filed: Jan. 31, 2002

(65) Prior Publication Data

US 2003/0142189 A1 Jul. 31, 2003

(51) Int. Cl.
*B41J 2/01* (2006.01)

(52) U.S. Cl. ..... 347/102; 101/488

(58) Field of Classification Search ..... 347/102, 347/101; 101/424.1, 488
See application file for complete search history.

(56) References Cited

U.S. PATENT DOCUMENTS

| | | | | | |
|---|---|---|---|---|---|
| 3,737,088 | A | * | 6/1973 | Barta et al. | 101/424.1 |
| 4,233,901 | A | * | 11/1980 | Mallinson | 101/424.1 |
| 4,246,839 | A | | 1/1981 | Willbanks | 347/55 |
| 4,340,893 | A | | 7/1982 | Ort | 347/102 |
| 4,469,026 | A | | 9/1984 | Irwin | 101/484 |
| 4,535,222 | A | | 8/1985 | Moen | 219/401 |
| 5,020,244 | A | | 6/1991 | Smith | 347/102 |
| 5,086,700 | A | * | 2/1992 | Van Den Berg | 101/416.1 |
| 5,190,201 | A | * | 3/1993 | Briggs | 101/424.1 |
| 5,287,123 | A | | 2/1994 | Medin et al. | 347/17 |
| 5,317,127 | A | | 5/1994 | Brewster, Jr. et al. | 219/388 |
| 5,528,271 | A | | 6/1996 | Ebisawa | 347/34 |
| 5,625,398 | A | * | 4/1997 | Milkovits et al. | 347/102 |
| 5,712,672 | A | | 1/1998 | Gooray et al. | 347/102 |
| 5,791,247 | A | * | 8/1998 | Kolb | 101/232 |
| 6,152,030 | A | * | 11/2000 | Fuqua | 101/115 |
| 6,168,269 | B1 | * | 1/2001 | Rasmussen et al. | 347/102 |
| 6,176,184 | B1 | * | 1/2001 | Mudry | 101/424.1 |
| 6,266,079 | B1 | * | 7/2001 | Gershony et al. | 347/251 |
| 6,293,196 | B1 | * | 9/2001 | DeMoore et al. | 101/416.1 |
| 6,308,626 | B1 | * | 10/2001 | Crystal et al. | 101/424.1 |
| 6,382,850 | B1 | * | 5/2002 | Freund et al. | 347/102 |
| 6,428,159 | B1 | * | 8/2002 | Roy et al. | 347/102 |

FOREIGN PATENT DOCUMENTS

| | | | |
|---|---|---|---|
| GB | 2126974 | A * | 4/1984 |

* cited by examiner

*Primary Examiner*—Manish Shah
*Assistant Examiner*—Leonard Liang
(74) *Attorney, Agent, or Firm*—Birdwell & Janke, LLP

(57) ABSTRACT

An ink drying system for high speed printing. A plurality of plenums are in fluid communication with a source of pressurized gas, mediated by respective fast acting valves. In a first embodiment of the invention, each plenum contains a plurality of small orifices grouped to define a localized drying area. The localized drying areas of the plenums form a substantially continuous drying region that, preferably, spans the entire lateral extent of the largest printed image. In a second embodiment of the invention, the plenums are spaced apart along the direction of travel of the sheet, and orifices of each plenum are distributed over the entire drying region.

21 Claims, 2 Drawing Sheets

INK DRYING SYSTEM FOR HIGH SPEED PRINTING

The present invention relates to an ink drying system for high speed printing, such as high speed ink-jet printing.

In a typical commercial printer, material to be imprinted travels as one or more sheets past a printing head which deposits ink on the material. Thereafter, the material is operated on by what are referred to as "after-print stations," which implement steps of stacking or folding the material, or rolling the material onto a drum. At this time, the ink should be dry or it will smear, or mark or bleed through and contaminate adjacent material. The speed of the material multiplied by the time required for drying gives the distance over which the material must travel past the printing head before being stacked or rolled onto the drum. Accordingly, decreasing drying time can result directly in real estate and time savings, and therefore cost savings that can be significant.

The prior art includes many different schemes for drying ink, including the use of radiant, convective and self-conductive (e.g., microwave heating) means to accelerate ambient drying. However, the amount of ink deposited typically varies across the material, particularly when printing graphics. Yet prior art drying schemes cannot account for a difference in the amount of drying energy that would ideally be applied as a function of location on the material, resulting in, at one extreme, under-drying at some locations and, at the other, overheating of the material at other locations.

Accordingly, there is a need for an ink drying system for high speed printing that provides for localized control of the amount of drying energy applied to a traveling sheet of material, for drying of ink deposited thereon.

SUMMARY OF THE INVENTION

The invention disclosed herein is an ink drying system for high speed printing. Within the scope of the invention, there is a plurality of gas plenums for disposition above or below a traveling sheet of material which contains varying amounts of ink to be dried as a function of location on the material. In a first embodiment, each plenum contains a plurality of small orifices grouped to define a localized drying area. The localized drying areas of the plenums form a substantially continuous drying region that, preferably, spans the entire lateral extent of the largest printed image.

In a second embodiment, the plenums are spaced apart along the direction of travel of the sheet, and orifices of each plenum are distributed over the entire drying region.

In either embodiment, the plenums are in fluid communication with a pressurized gas at a controlled temperature whose flow through the plenums is controlled by respective fast acting valves. Preferably, the orifices are sized and the gas pressure provided so that the velocity of the gas through the orifices is extremely high, so that very low volumes of the gas are expended and so that turbulence at the surface of the material is ensured, resulting in a very high rate of energy transfer from the gas to the ink.

Therefore, it is an object of the present invention to provide a novel and improved ink drying system for high speed printing.

It is a further object of the present invention to provide an ink drying system for high speed printing that provides for localized control of the amount of drying energy applied to a traveling sheet of material.

It is still a further object of the present invention to provide an ink drying system for high speed printing that provides for conserving the amount of a gas and heat energy used for drying.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
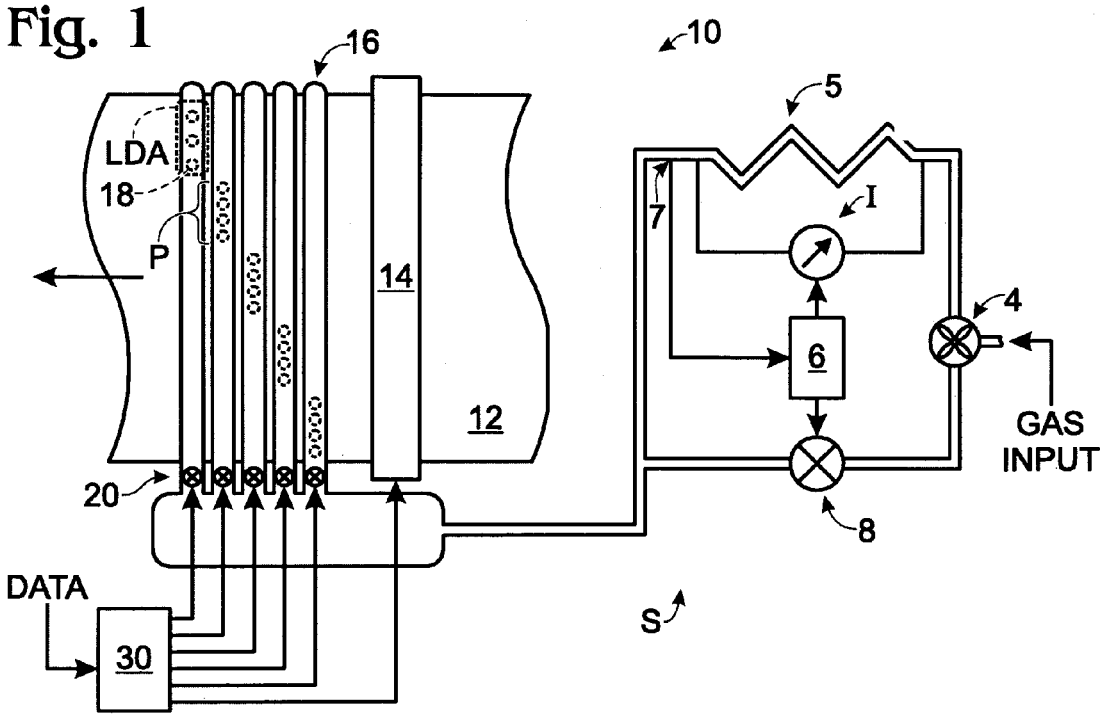
FIG. 1 is a schematic, plan view of a first embodiment of an ink drying system for high speed printing according to the present invention.

Referring to FIG. 1, an ink drying system 10 for high speed printing according to a first embodiment of the present invention is shown. A sheet 12 of material to be imprinted is passed by a printing head 14 in a longitudinal direction of travel, as indicated by the arrow, at speeds which may reach up to about 5 m/s. The printing head 14 can be any device for depositing ink; however, ink-jet printheads are increasingly being used, and the invention is believed to provide its greatest advantages when used in conjunction with ink-jet printing.

An ink-jet printhead typically deposits ink on the material along a line referred to herein as a "scan" line that is oriented perpendicular to the direction of travel of the material. However, as will be readily appreciated, any pattern of ink on the material can be described as a set of adjacent scan lines, whether deposited in that manner or not.

Where the sheet is long, it is often referred to as a "web." The term "sheet" as used herein can also be one or more individual or cut sheets of any size.

The drying system 10 includes a plurality of gas plenums 16, that may be disposed above or below the sheet 12, and that generally extend laterally with respect to the direction of sheet travel, so as to cover the lateral width of the widest ink pattern that is anticipated. The plenums deliver to the sheet a heated gas at high velocity. High velocity air-jet drying is generally disclosed in Moen U.S. Pat. No. 4,535,222, incorporated by reference herein in its entirety.

Temperature controlled, pressurized gas is received by the plenums 16 from a source "S." The source comprises a pump 4 which receives a gas from a first gas input and pressurizes the gas, introducing it into a heater 5, which is preferably a length of metal tubing through which the gas flows, the metal tubing being caused to carry an electrical current by a current source "I" for resistance heating. A controller 6 receives a temperature indication from a thermocouple 7 to control the current source "I" for regulating the temperature of the heated gas as it exits the heater. To increase the control speed, the pump 4 may also supply the unheated gas to a valve 8 which is also controlled by the controller 6, for mixing cool gas with the heated gas. With the temperature of the heated gas maintained at a desired maximum, the controlled injection of cooler gas allows for varying the temperature as desired.

The plenums themselves may also be used as electrical resistance heaters, minimizing the distance the gas must travel between the time it is heated and the time it is applied to the material for drying the material, which increases the ability to control the drying as well as decreases heat loss.

While the source "S" is shown coupled to the plenums at one end of the plenums for simplicity, the source is preferably coupled into the plenums at other locations, such as at their ends, to minimize pressure and heat loss therein.

Figure 2:
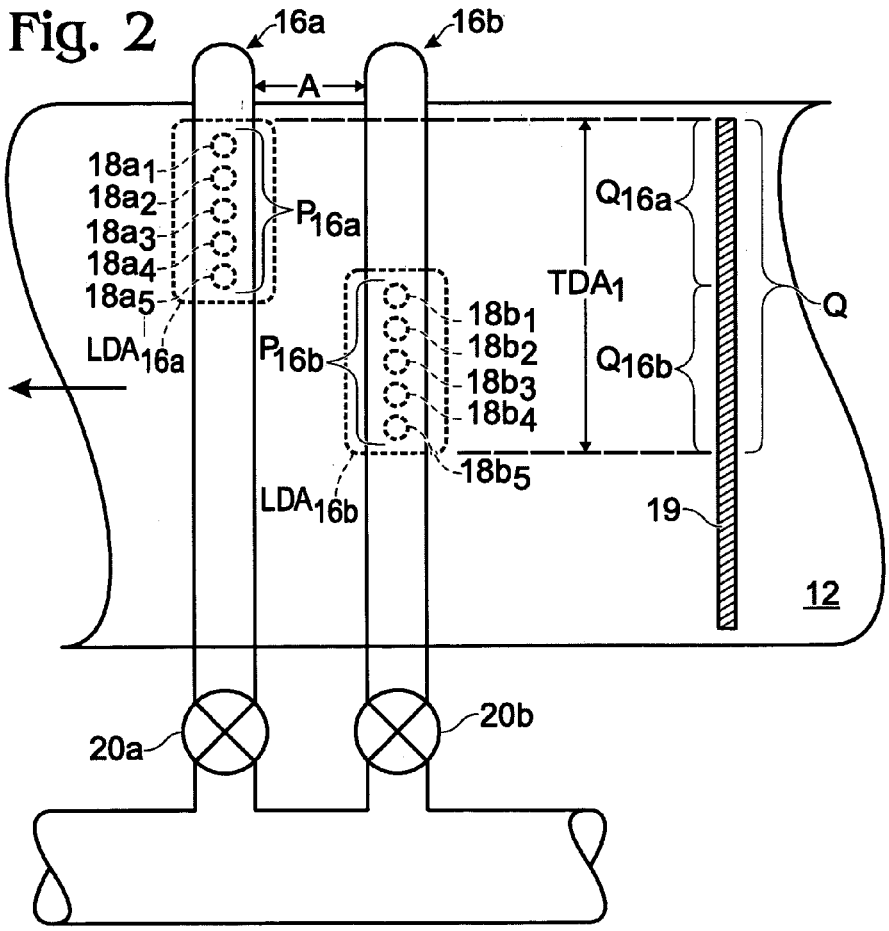
FIG. 2 is a schematic, plan view of the ink drying system of FIG. 1, showing greater detail.

Each plenum includes a plurality of orifices 18 that are directed so that gas flow through the orifices is aimed at the sheet. The orifices for each plenum are grouped to cover a localized drying area "LDA" on the sheet, by being provided in a corresponding localized portion "P" of the plenums. For example, with reference to FIG. 2, the plenum 16*a* includes orifices $\mathbf{18}a_1$–$\mathbf{18}a_5$ which are sequentially spaced over the portion $P_{16a}$ to cover the localized drying area $LDA_{16a}$. Similarly, the plenum 16*b* includes orifices $\mathbf{18}b_1$–$\mathbf{18}b_5$ which are sequentially spaced over the portion $P_{16b}$ to cover the localized drying area $LDA_{16b}$.

The portions P are distributed laterally across the sheet 12 so that, together, all of the portions P provide a total drying area "TDA" that covers the lateral extent over which drying is desired. For example, still referring to FIG. 2, the portions $P_{16a}$ and $P_{16b}$ are adjacent one another and, together, form a total drying area $TDA_1$ having a lateral extent as shown by the arrows. As a laterally extending line of printing referenced as 19 advances past the two drying areas $LDA_{16a}$ and $LDA_{16b}$, drying energy is applied to a similarly laterally extending portion "Q" of the line 19, wherein a sub-portion of the line $Q_{16a}$ is dried by the drying portion $P_{16a}$, and a sub-portion $Q_{16b}$ is dried by the drying portion $P_{16b}$. The two sub-portions can be provided a different amounts of gas flow or drying energy by appropriate appropriate control of two respective fast acting valves 20*a* and 20*b*. This would be desirable if, for example, there is more ink deposited in one of the sub-portions $Q_{16}$ than the other.

The aforedescribed structure is a low resolution example of providing for laterally varying drying capabilities. Preferably, there are more plenums so that a larger number of smaller local drying areas are provided, providing for greater drying resolution. However, resolution for a given orifice is limited by the distance between the orifice and the sheet, since the gas quickly expands as it exits the orifice, so this distance is preferably kept at a minimum.

The lateral extent of the localized drying areas may also be used to define a similar longitudinal resolution from which the maximum desired cycle speed of the fast acting valves 20 may be calculated. For example, assuming a localized drying area about 2 cm in diameter and a sheet speed of 10 m/s, the valves 20 should be able to cycle in about 2 milliseconds, i.e., the desired longitudinal dimension of drying resolution divided by the sheet speed.

Temperature controlled, pressurized gas is supplied to the plenums 16, and the pressure of the gas and the size of the orifices are adapted so that the gas exits the orifices at very high speed. The high speed may used to compensate for a diminished quantity of the gas, saving in pumping and heating costs, providing an outstanding advantage. Preferably, the orifices have a diameter of 0.040" and gas is forced therethrough at velocities of about 125 m/s by a pressure of 20–100 psig.

Figure 3:
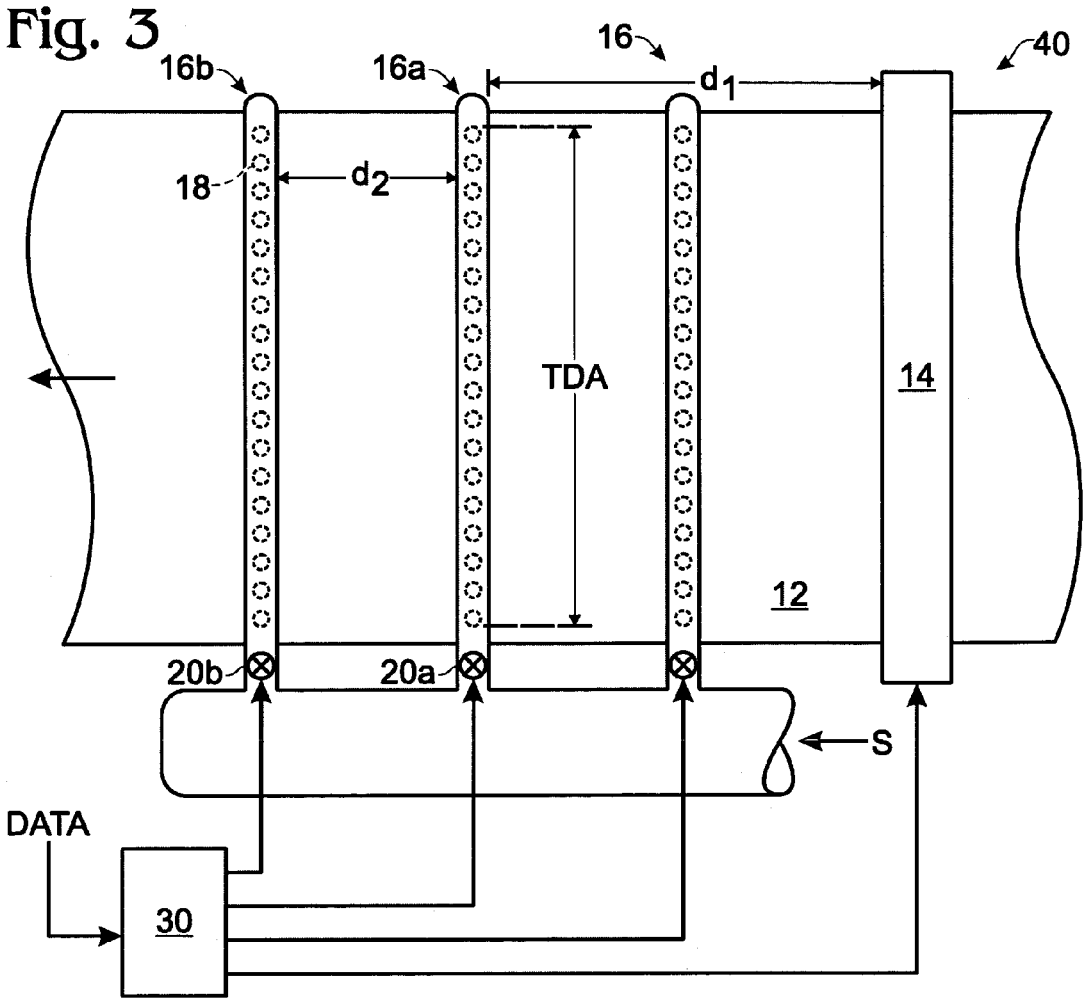
FIG. 3 is a schematic, plan view of a second embodiment of an ink drying system for high speed printing according to the present invention.

Turning to FIG. 3, a second embodiment 40 of an ink drying system for high speed printing according to the present invention is shown. The system 40 is similar to the system 10, except that laterally varying drying control is not particularly sought, and instead control is provided in the longitudinal dimension. The orifices 18 of each of the plenums 16 are spaced from one another so as to span entirely the total drying area TDA. The plenums are spaced apart from one another along the longitudinal dimension. Again, each plenum 16 communicates with a source "S" of pressurized gas through a respective fast acting valve 20. In this embodiment, the rate at which drying energy is applied can be tailored to a given laterally extending region of print. Particularly, drying energy is applied to the region by each plenum in succession as the region travels downstream of the printing head. The energy applied to the given region may be tailored with respect to the energy applied to other regions, by cycling the valves 20 so that a desired program of gas flow "follows" movement of the region. For example, supposing there are two plenums 16*a* and 16*b* spaced apart from one another along the longitudinal dimension indicated by the arrow. A printing head 14 lays down a laterally extending region of print corresponding to a total drying area "TDA" which travels at the speed of the sheet 12. After having been imprinted, the region TDA arrives at the plenum 16*a* at a time equal to $d_1$ divided by the speed of the sheet, and the fast acting valve 20*a* is operated to effect a desired flow of the gas therethrough, according to a selected "program" of drying energy for the region TDA. Later, at a time equal to the quantity $(d_1+d_2)$ divided by the speed of the sheet since the region TDA was printed, the region arrives at the plenum 16*b*, and the fast acting valve 20*b* is operated according to the same program. The program may provide for identical amounts of drying energy to be provided for the region TDA by each of the plenums, or it may provide for sequential attenuations of the drying energy, corresponding to the respective time delays in reaching the plenums, that take into account anticipated changes in the need for drying energy for drying the region as it moves downstream.

The speed capabilities of the fast acting valves 20 for the embodiment 40 are determined in the same manner as described above for the embodiment 10. That is, unless the spacing between the plenums 16 is less than the desired longitudinal resolution, the valves should be able to cycle at a rate that provides for changing the program at any given plenum at a rate defined by the desired longitudinal resolution divided by the speed of the sheet. Providing for spaced apart plenums allows for applying drying energy over a period of time, which generally increases drying efficiency.

The features provided by the embodiment 10 may be combined with the features provided by the embodiment 40, so that variations in the drying energy may be provided both across the sheet at a given longitudinal dimension, and along the length of the sheet during transit of a particular region of ink.

The valves 20 may be cycled between "on" (full flow) and "off" (no flow) conditions; however, the valves may be further adapted to open and close controllable amounts to meter the flow of gas through the plenum for greater control.

The valves are controlled by a controller 30 (FIGS. 1 and 2) that is provided information ("data") about what is being, or is about to be, printed by the printing head by any number of means that will be immediately apparent to those of ordinary skill. For example, a line of ink jet printing will generally consist of a countable number of droplets of ink of a particular color for each pixel of the line, distributed over the total number of pixels making up the line. Knowing the amount of ink deposited in each pixel and the locations thereof, the controller can then operate the appropriate valves 20 to achieve an appropriate drying energy at each location. Time delays in the system may be compensated by adapting the controller to read the information in advance of printing the information. The controller 30 may be provided the information necessary to control the printing head 14 as shown in FIGS. 1 and 3.

While preferred embodiments of the invention have been described in the context of a single printing head 14, a number of different printing heads may be employed in the system, e.g., corresponding to different colors, and associated plenums provided to dry the different colored inks may be physically adapted and/or controlled to treat the different colored inks differently.

While the plenums 16 are shown and described in a linear configuration extending laterally across the sheet for drying a "scan line" having a correspondingly similar geometry and orientation, the plenums can have any geometric configuration or orientation that is desired without departing from the principles of the invention.

It is more generally to be recognized that, while a particular ink drying system for high speed printing has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A method for drying ink in a high speed printing system, the ink being deposited on a sheet of material traveling in a predetermined direction, the system being coupled to a source of pressurized gas and comprising the steps of:

providing a first plenum disposed so as to extend over the sheet;

providing a second plenum disposed so as to extend over the sheet, wherein said plenums each include an associated plurality of orifices spaced apart from one another so as to define respective drying portions thereof, wherein said plenums are spaced substantially apart from one another in the direction of travel of the sheet a predetermined distance, and wherein the drying portions of said plenums are each substantially laterally co-extensive;

selecting one of said two plenums to receive a first predetermined amount of the pressurized gas at a first time; and selecting the other of said two plenums to receive a second predetermined amount of the pressurized gas at a second time, wherein said second amount of the pressurized gas is predetermined based on said first amount, and wherein the difference between said first time and said second time is substantially equal to said distance divided by the speed of travel of the sheet.

2. An ink drying system for high speed printing with liquid ink on a traveling sheet of material, the system being coupled to a source of pressurized gas and comprising: a first plenum disposed so as to extend over the sheet and define a first drying portion of said first plenum for directing the gas through said first plenum onto the sheet for drying the ink; a first fluid flow valve for varying the flow rate of the gas through said first plenum; and a controller for receiving first information specifically relating to a drying energy required of said first drying portion for drying a portion of the ink deposited on the sheet and automatically controlling said first fluid flow valve so as to vary said flow rate of said gas and therefore said drying energy in response to said first information before said portion completely dries, for causing said drying of said portion.

3. The ink drying system of claim 2, wherein said controller is adapted to control said first fluid valve in response to changes in the drying energy required of said first drying portion for drying different lines of printing.

4. The ink drying system of claim 2, further comprising at least a second plenum disposed so as to extend over the sheet and define a second drying portion of said second plenum for directing the gas through said second plenum onto the sheet, a second fluid flow valve for varying the flow rate of the gas through said second plenum, wherein said controller is adapted to receive second information for determining the drying energy required of said second drying portion and to automatically control said second fluid flow valve in response to said second information, for drying ink deposited on the sheet.

5. The system of claim 4, wherein said drying portions provide substantially complete laterally extending coverage of the sheet, and wherein said first drying portion provides a substantially different range of laterally extending coverage of the sheet than said second drying portion.

6. The system of claim 5, wherein a quantity of the ink is defined by a spatially varying distribution, and wherein said controller is adapted, based on said distribution, to select one of said first and second plenums to receive more of the pressurized gas than the other of said first and second plenums.

7. The ink drying system of claim 6, further comprising a plurality of ink jet printheads for depositing the ink, wherein said first information includes the amount of ink deposited by one of said plurality of ink jet printheads and wherein said second information includes the amount of ink deposited by another of said plurality of ink jet printheads.

8. The system of claim 4, wherein a quantity of the ink is defined by a spatially varying distribution, and wherein said controller is adapted, based on said distribution, to select one of said first and second plenums to receive more of the pressurized gas than the other of said first and second plenums.

9. The system of claim 4, wherein said first and second plenums are spaced substantially apart from one another in a direction of travel of the sheet by a predetermined distance, wherein said first and second drying portions are each substantially laterally co-extensive, wherein said controller is adapted to select one of said first and second plenums to receive a first predetermined amount of the pressurized gas at a first time, and to select the other of said first and second plenums to receive a second predetermined amount of the pressurized gas at a second time, wherein said second amount of the pressurized gas is predetermined based on said first amount, and wherein the difference between said first time and said second time is substantially equal to said distance divided by the speed of travel of the sheet.

10. The ink drying system of claim 2, further comprising at least one ink jet printhead for depositing the ink, wherein said first information includes the amount of ink deposited by said at least one ink jet printhead.

11. The ink drying system of claim 2, wherein said first information comprises substantially instantaneous flow volume data for the liquid ink.

12. A method for high speed printing with liquid ink on a traveling sheet of material, comprising the steps of: providing a first plenum disposed so as to extend over the sheet and define a first drying portion of said first plenum for directing pressurized gas through said first plenum onto the sheet for drying the ink; receiving first information specifically relating to a drying energy and a flow rate of the gas required of said first drying portion for drying a portion of the ink deposited on the sheet; and automatically controlling the flow rate of the gas through said first plenum and therefore said drying energy in response to said first information before said portion completely dries, for causing said drying of said portion.

13. The method of claim 12, further comprising providing at least a second plenum disposed so as to extend over the sheet and define a second drying portion of said second plenum for directing the gas through said second plenum onto the sheet, receiving second information for determining the drying energy required of said second drying portion, and automatically controlling the flow rate of the gas through said second plenum in response to said second information, for drying ink deposited on the sheet.

14. The method of claim 13, wherein said drying portions provide substantially complete laterally extending coverage of the sheet, and wherein said first drying portion provides a substantially different range of laterally extending coverage of the sheet than said second drying portion.

15. The method of claim 14, wherein a quantity of the ink is defined by a spatially varying distribution, and wherein said controlling, based on said distribution, comprises selecting one of said first and second plenums to receive more of the pressurized gas than the other of said first and second plenums.

16. The method of claim 15, further comprising providing a plurality of ink jet printheads for depositing the ink, wherein said first information includes the amount of ink deposited by one of said plurality of ink jet printheads and wherein said second information includes the amount of ink deposited by another of said plurality of ink jet printheads.

17. The method of claim 13, wherein a quantity of the ink is defined by a spatially varying distribution, and wherein said controlling comprises selecting, based on said distribution, one of said first and second plenums to receive more of the pressurized gas than the other of said first and second plenums.

18. The method of claim 13, wherein said first and second plenums are spaced substantially apart from one another in a direction of travel of the sheet by a predetermined distance, and wherein said first and second drying portions are each substantially laterally co-extensive, wherein said controlling comprises selecting one of said first and second plenums to receive a first predetermined amount of the pressurized gas at a first time, and selecting the other of said first and second plenums to receive a second predetermined amount of the pressurized gas at a second time, wherein said second amount of the pressurized gas is predetermined based on said first amount, and wherein the difference between said first time and said second time is substantially equal to said distance divided by the speed of travel of the sheet.

19. The method of claim 12, further comprising controlling said first fluid valve in response to changes in the drying energy required of said first drying portion for drying different lines of printing.

20. The method of claim 12, further comprising providing at least one ink jet printhead for depositing the ink, wherein said first information includes the amount of ink deposited by said at least one ink jet printhead.

21. The method of claim 12, wherein said first information comprises substantially instantaneous flow volume data for the liquid ink.

* * * * *